United States Patent [19]

Kishi et al.

[11] Patent Number: 4,596,508

[45] Date of Patent: Jun. 24, 1986

[54] EARTH-WORKING MACHINE

[76] Inventors: Mitsuhiro Kishi, 1320 Mizuhonocho, Ashikaga-shi, Tochigi-prefecture 326-03; Yokichi Nagasawa, 1902, Honjo 2-chome, Ashikaga-shi, Tochigi-prefecture 326, both of Japan

[21] Appl. No.: 503,688

[22] Filed: Jun. 13, 1983

[30] Foreign Application Priority Data

| | | | |
|---|---|---|---|
| Jul. 22, 1982 | [JP] | Japan | 57-128468 |
| Sep. 18, 1982 | [JP] | Japan | 57-162971 |
| Nov. 1, 1982 | [JP] | Japan | 57-192120 |
| Jan. 28, 1983 | [JP] | Japan | 58-13376 |

[51] Int. Cl.[4] ..... E02F 5/02

[52] U.S. Cl. ..... 414/687; 74/52; 74/803; 414/694; 212/247

[58] Field of Search ..... 414/694, 687, 742; 212/245–248; 74/803, 421 R, 421 A; 180/6.58; 248/349, 652, 666; 104/35–47, 192; 108/94; 414/742

[56] References Cited

U.S. PATENT DOCUMENTS

| | | | |
|---|---|---|---|
| 287,631 | 10/1883 | Cook | 212/247 X |
| 3,575,307 | 4/1971 | Guinot | 414/694 |
| 3,664,528 | 5/1972 | Gauchet | 414/694 |
| 4,433,495 | 2/1984 | Kishi | 414/694 X |

*Primary Examiner*—Donald W. Underwood
*Attorney, Agent, or Firm*—Martin A. Farber

[57] ABSTRACT

An earth-working machine such as an excavator includes a mobile chassis having a support base on which an internal or external gear is fixedly mounted. A slider ring is mounted on the underside of a turntable with a hydraulic motor mounted thereon and having a drive pinion held in mesh with the internal or external gear. A carriage supporting an excavating mechanism has an internal or external gear fixed to the underside of the carriage and rotatably mounted on an annular holder fixed to the turntable. An intermediate shaft is rotatably journalled in at least one bearing mounted on the turntable and has a pair of pinions fixed thereto and held in mesh with the gears, respectively. Alternatively, an intermediate shaft may have a pinion held in driving mesh with the gear secured to the carriage and driven by another hydraulic motor mounted on the turntable through sprockets and a chain trained therearound. As a further alternative, another hydraulic motor is mounted on the turntable and has a pinion held in driving mesh with the gear on the carriage, and the pinions on the intermediate shaft may be disconnected by a clutch means.

12 Claims, 21 Drawing Figures

EARTH-WORKING MACHINE

BACKGROUND OF THE INVENTION

The present invention relates to an earth-working machine such as an excavator for digging ditches in road construction.

As shown in FIG. 1 of the accompanying drawings, a known excavator 1 for trenching a ditch in and along one lane of a road is placed on that lane, blocking off the traffic on the lane while allowing the traffic on the other lane. In operation, a bucket arm 2 of the excavator 1 is moved up and down to cause a bucket 3 on the bucket arm 2 to dig a trench 4 in and along the road lane. The material scooped by the bucket 3 is then dumped onto a loading platform 6 of a truck 5 positioned behind the excavator 1. As the trench 4 is digged on successively, the excavator 1 is required to move back in the direction of the arrow Z so as to be prevented from falling off into the trench 4 which has just been digged. For tranferring the digged material from the trench 4 over to the loading platform 6, it is necessary to turn the bucket 3 and hence the bucket arm 2 along a semicircular path Y about a center X of the excavator 1. Since the path Y of the bucket 3 extends into the other lane, the traffic on the other lane must be either stopped totally or interrupted only when the bucket arm 2 is to swing over for preventing any unwanted accident. However, such entire or temporary traffic interruption is bound to cause a traffic jam while the road is under construction. Furthermore, the large radius of swinging movement of the bucket arm 2 suffers from the danger of the bucket 3 to hitting and injuring careless people who may walk into the range of turning movement of the bucket arm 2.

SUMMARY OF THE INVENTION

It is an object of the present invention to provide an earth-working machine having an earth-working mechanism capable of turning along a path of a reduced radius.

Another object of the present invention is to provide an earth-working machine which can operate without interfering with other activities around the machine, such for example as traffic.

Still another object of the present invention is to provide an earth-working machine operable within a small space range to avoid unwanted accidents such as traffic accidents or injuries to people around the machine.

According to the present invention, a first gear is fixedly mounted on a mobile chassis of an earth-working machine and supports a turntable coaxially rotatably thereon. A carriage is rotatably mounted on the turntable in eccentric relation thereto and has a second gear with an earth-working mechanism such as a jib and a bucket being operatively mounted on the carriage. A hydraulic motor is mounted on the turntable and has a pinion held in driving mesh with the first gear for rotating the turntable. Means is mounted on the turntable for rotating the carriage, in response to or independently of rotation of the turntable, about an axis of the second gear through driving mesh with the second gear.

According to an embodiment, the means comprises a shaft journalled in a bearing supported on the turntable and a pair of second and third pinions fixed to the shaft and held in mesh with the first and second gears, respectively. The first and second gears comprise internal gears, respectively. The carriage can be rotated in a direction opposite to the direction in which the turntable rotates in synchronism with rotation of the turntable when the hydraulic motor is actuated.

According to another embodiment, the arrangement is substantially the same as that of the foregoing embodiment except that the first and second gears comprise external gears, respectively.

According to still another embodiment, the means has a second hydraulic motor mounted on the turntable, a first sprocket mounted on a first shaft of the second hydraulic motor, a second sprocket mounted on a second shaft journalled in a bearing supported on the turntable, a chain trained around the first and second sprockets in mesh therewith, and a second pinion mounted on the second shaft and held in driving mesh with the second gear. The carriage can be rotated by the second hydraulic motor independently of the turntable.

According to a still further embodiment, the means comprises a second hydraulic motor mounted on the turntable and having a second pinion held in driving mesh with the second gear. The carriage can be rotated by the second hydraulic motor independently of the turntable. The means also includes a shaft journalled in a bearing supported on the turntable and including an axial extension having splines, a third pinion fixed to the shaft and meshing with the first gear, a fourth pinion splined to the axial extension and normally held in driving mesh with the second gear, and clutch means actutable for shifting the fourth pinion on the axial extension axially out of meshing engagement with the second gear. The carriage can be rotated by the second hydraulic gear independently of the turntable when the clutch means is actuated. The clutch means comprises a support post mounted on the turntable, a lever pivotably mounted on the support post and having a roller rotatably mounted on the lever and riding in a groove defined in the fourth pinion, and an actuator rod connected to the lever for angularly moving the lever to shift the fourth pinion out of meshing engagement with the second gear.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
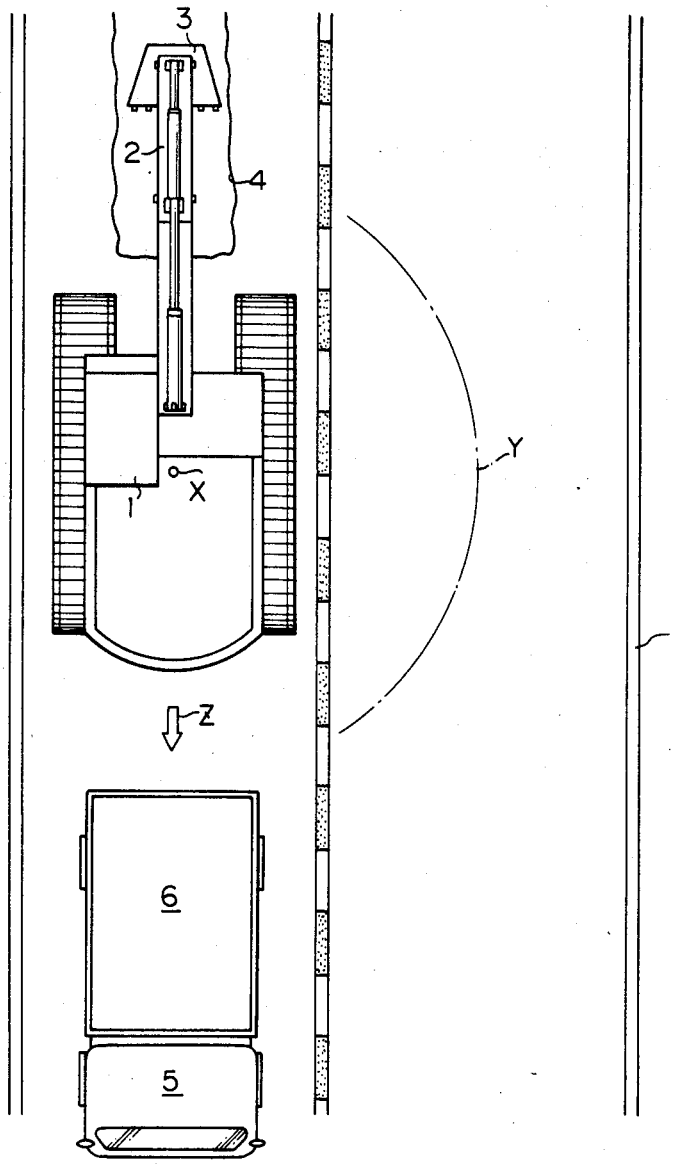
FIG. 1 PRIOR ART
FIG. 1 is a plan view of a conventional excavator as it operates to dig a ditch.

The present invention is particularly useful when embodied in an earth-working machine such as an excavator or trenching machine as shown in the drawings. Like or corresponding parts are denoted by like or corresponding reference characters throughout the views.

Figure 2:
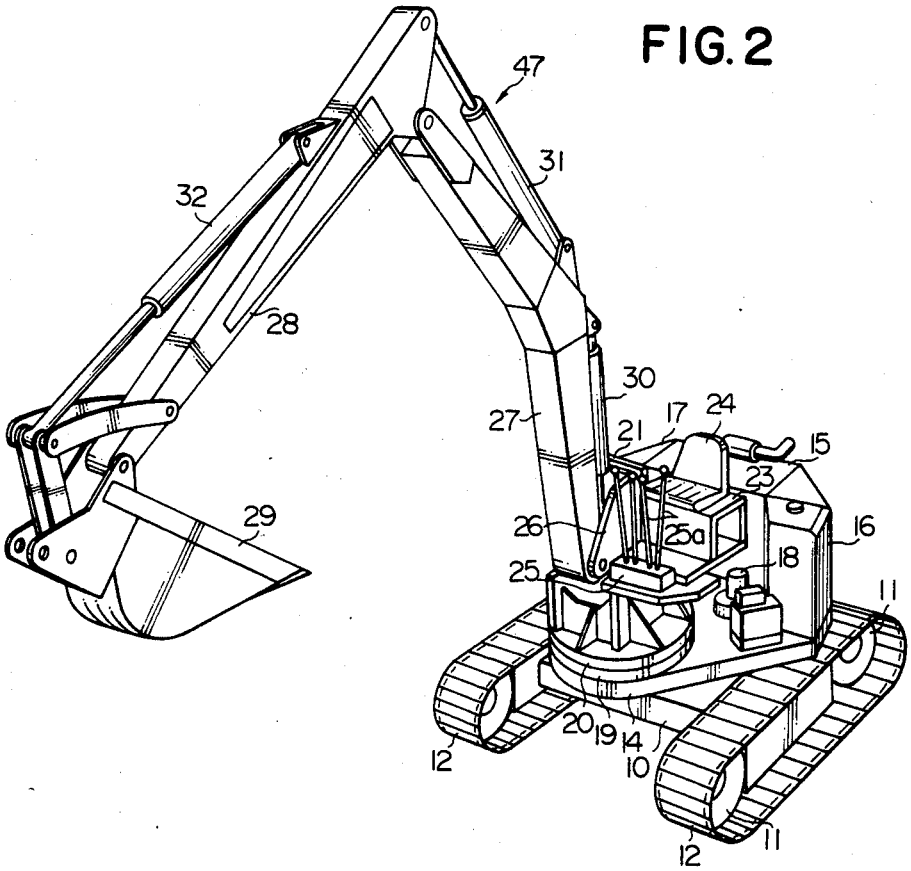
FIG. 2 is a perspective view of an excavator according to an embodiment of the present invention.
Figure 3:
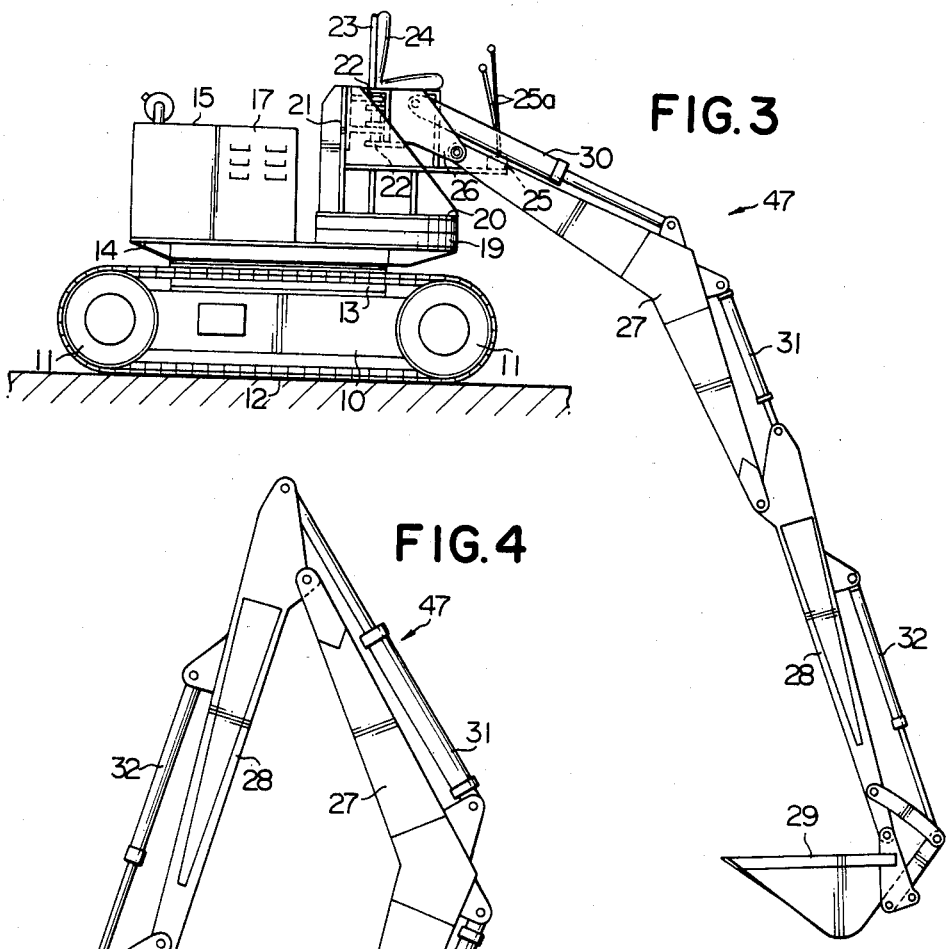
FIG. 3 is a side elevational view of the excavator shown in FIG. 2.
Figure 4:
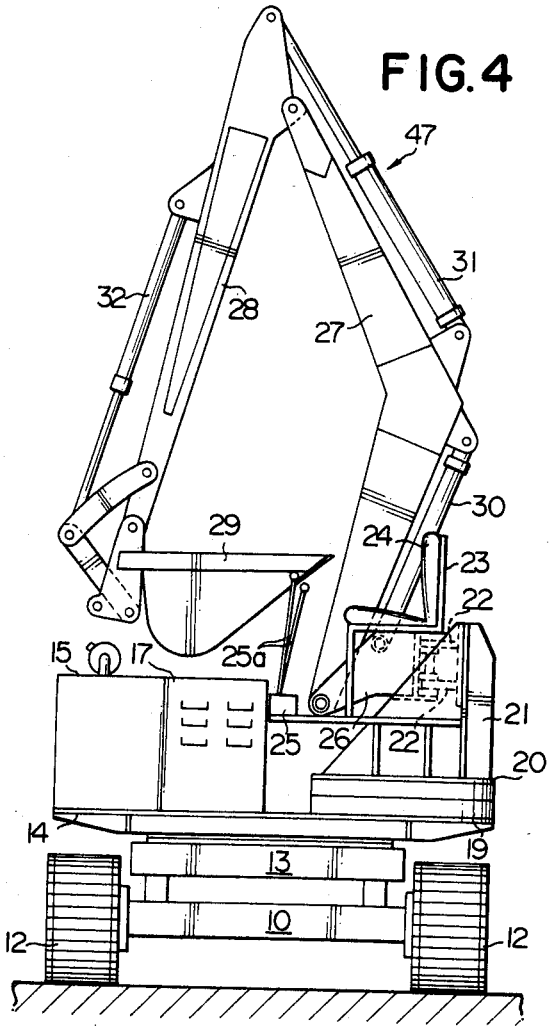
FIG. 4 is a front elevational view of the excavator of FIG. 2.
Figure 5:
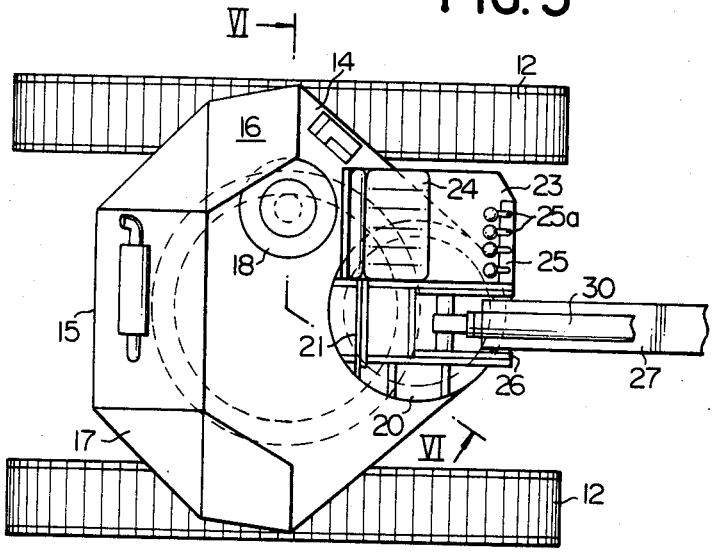
FIG. 5 is a plan view of the excavator of FIG. 2.

As shown in FIGS. 1 through 8, the excavator is of the self-propelled type having a flat mobile chassis 10 supporting four wheels 11 with an endless track 12 trained around each pair of wheels 11. The mobile chassis 10 inculdes a central support base 13 (FIGS. 3, 4 and 6) mounted thereon and having an upper annular flange on which a horizontal turntable 14 of an octagonal configuration is rotatably mounted. As better shown in FIG. 5, the turntable 14 supports thereon an engine 15, a fuel tank 16, and a hydraulic oil tank 17 arranged along a rear edge of the turntable 14. A hydraulic motor 18 is also mounted on the turntable 14 adjacent to the fuel tank 16 and has a drive shaft 36 (FIG. 6) directed downwardly of the turntable 14. As illustrated in FIGS. 2 and 3, an annular horizontal holder base 19 is fixedly mounted on the turntable 14 at a front edge thereof. The annular holder base 19 has an axis held in horizontally eccentric relation to the axis of the support base 13 and hence the turntable 14. A circular carraige 20 is rotatably mounted coaxially on the holder base 19.

As shown in FIG. 3, the carriage 20 includes a vertical support 21 to which a pair of vertically spaced legs 22 is secured. A bracket 26 is pivotably mounted on the legs 22 and supports thereon a bent boom 27 which is vertically angularly movable about a pivot on the bracket 26. The boom 27 supports on its distal end a bucket arm 28 having a bucket 29 pivotably mounted on a distal end of the bucket arm 28. Hydraulic cylinders 30, 31, 32 are coupled respectively between the bracket 26 and a central portion of the boom 27, between a central portion of the boom 27 and an end of the bucket arm 28, and between the bucket arm 28 and the bucket 29. The boom 27, the bucket arm 28, the bucket 29, and the hydraulic cylinders 30, 31, 32 jointly constitute an excavating mechanism 47. The bracket 26 also supports a seat base 23 on which there are mounted an operator seat 24 and a hydraulic control box 25 having a plurality of control levers 25*a*.

Figure 6:
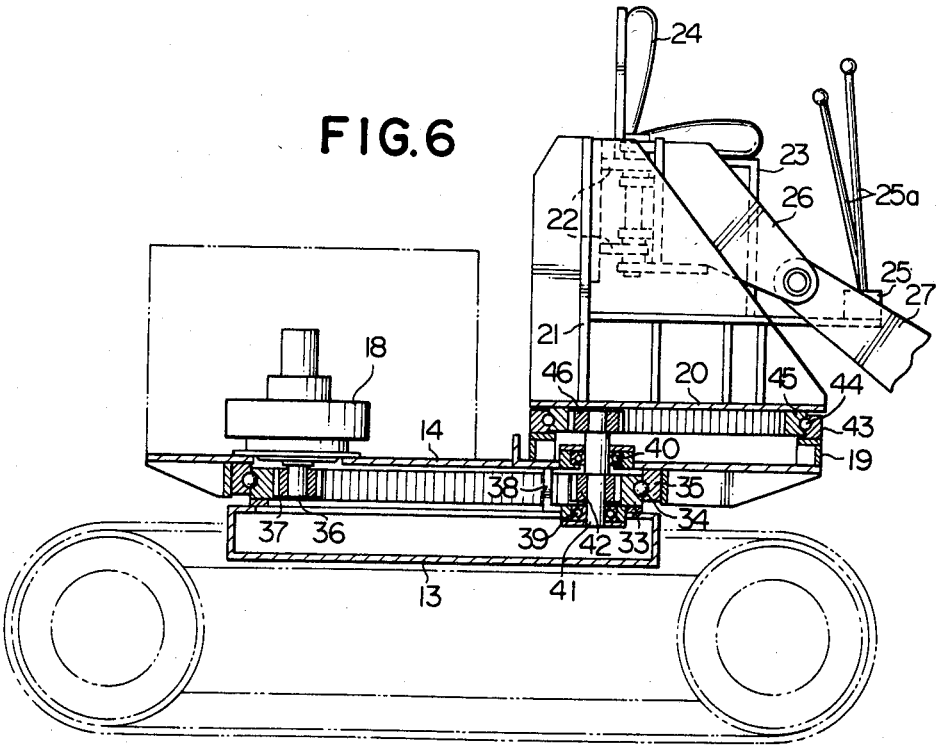
FIG. 6 is an enlarged cross-sectional view taken along line VI—VI of FIG. 5.

As illustrated in FIG. 6, an annular internal gear 33 is fixedly mounted on the annular flange of the support base 13. The turntable 14 has a slider ring 35 disposed securely therebelow and rotatably fitted over the internal gear 33 with ball bearings 34 interposed therebetween. Accordingly, the turntable 14 is rotatable coaxially on the first gear 33. A pinion 37 is fixed to the drive shaft 36 of the hydraulic motor 18 and held in driving mesh with the internal gear 33. The turntable 14 has an L-shaped bracket 38 extending downwardly therefrom into the internal gear 33. A pair of bearings 39, 40 is affixed respectively to the bracket 38 and the turntable 14. An intermediate vertical shaft 41 is rotatably journalled in the bearings 39, 40 and has a pinion 42 secured thereto and interposed between the bearings 39, 40, the pinion 42 meshing with the internal gear 33. The holder base 19 supports thereon an annular holder 43 affixed coaxially thereto. The carriage 20 has an annular internal gear 45 fixed to the underside thereof and rotatably fitted in the annular holder 43 with ball bearings 44 interposed therebetween. Therefore, the carriage 20 is rotatable coaxially with the annular holder 43. The intermediate shaft 41 has an upper end projecting upwardly beyond the turntable 14 into the internal gear 45 and having a pinion 46 secured thereto and held in mesh with the internal gear 45.

Operation of the excavator thus constructed is as follows: The control levers 25*a* are actuated by the operator sitting on the seat 24 to operate the hydraulic cylinders 30, 31, 32 to move the bucket 29 up and down for digging a ditch. The bucket 29 with the scooped material therein is brought from the position shown in FIG. 3 to the position of FIG. 4 in which the bottom of the bucket 29 is located slightly higher than the various devices on the turntable 14. The bucket 29 is then turned rearwardly of the chassis 10 toward a truck (not shown) parked behind the excavator.

Figure 7:
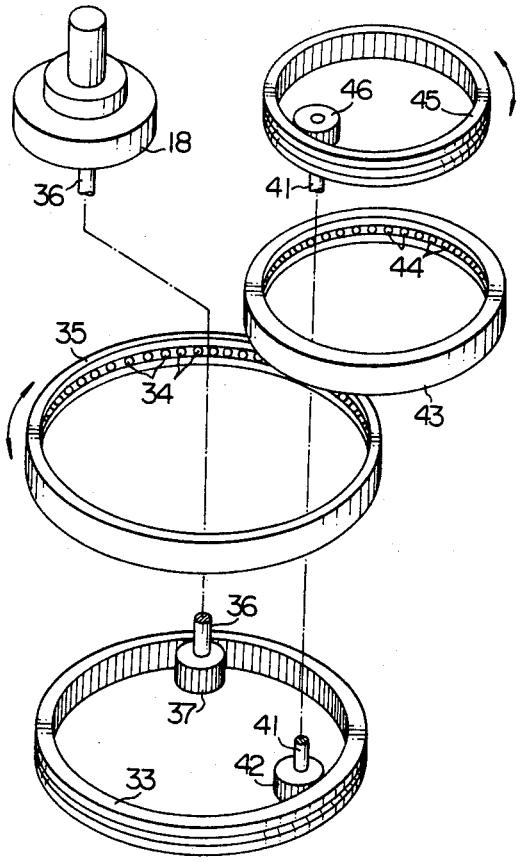
FIG. 7 is an exploded perspective view of a turning mechanism on the excavator illustrated in FIG. 6.
Figure 8:
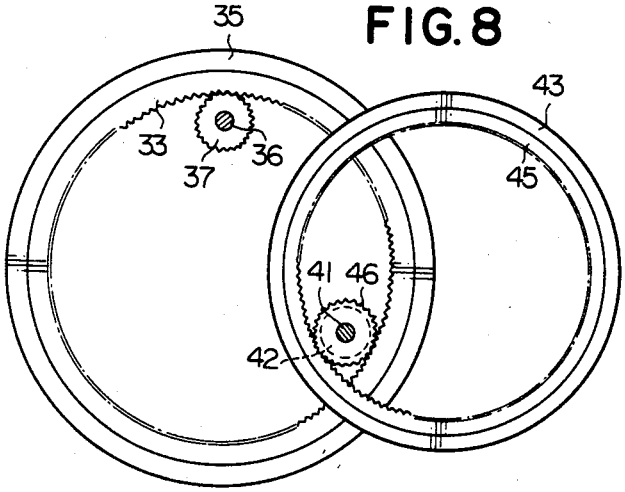
FIG. 8 is a plan view of the turning mechanism, as assembled, of FIG. 7.
Figure 9:
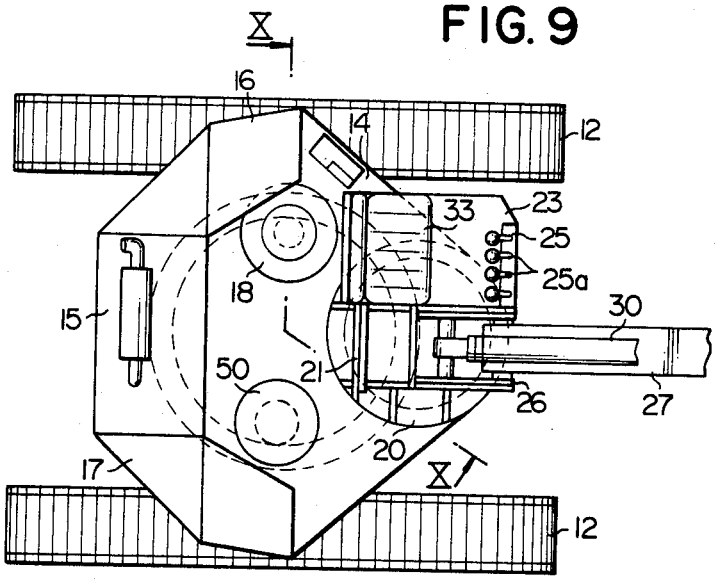
FIG. 9 is a plan view of an excavator according to another embodiment of the present invention.

To enable the bucket 29 to make such a turning movement, oil under pressure is supplied to the hydraulic motor 18 to rotate the drive shaft 36 thereof. The pinion 37 is rotated meshing with the internal gear 33 thereby rotating the slider ring 35 around the internal gear 33, as shown in FIGS. 7 and 8. The turntable 14 fixed to the slider ring 35 is now rotated about the axis of the internal gear 33. When the turntable 14 is thus rotated, the pinion 42 fixed to the intermediate shaft 41 is also caused to rotate meshing with the internal gear 33, whereupon the intermediate shaft 41 and the pinion 46 are also rotated in synchronism with the rotation of the turntable 14. The rotation of the pinion 46 causes the internal gear 45 meshing therewith to rotate about its own axis within the annular holder 43 in a direction opposite to the direction in which the turntable 14 rotates. Accordingly, the carriage 20 secured to the internal gear 45 is also caused to rotate therewith in the direction opposite to that of rotation of the turntable 14. The excavating mechanism 47 is angularly moved with the carriage 20 from a front position to a rear position over the devices on the turntable 14 without allowing the bucket 29 projecting sideways of the chassis 10. The excavating mechanism 47 is thus rotated about the axis of the carriage 20 while revolving about the axis of the turntable 14. As a consequence, the excavating mechanism 47 moves in a minimum space range on rearward movement over the chassis 10 without laterally projecting out of the width of the chassis 10.

Figure 10:
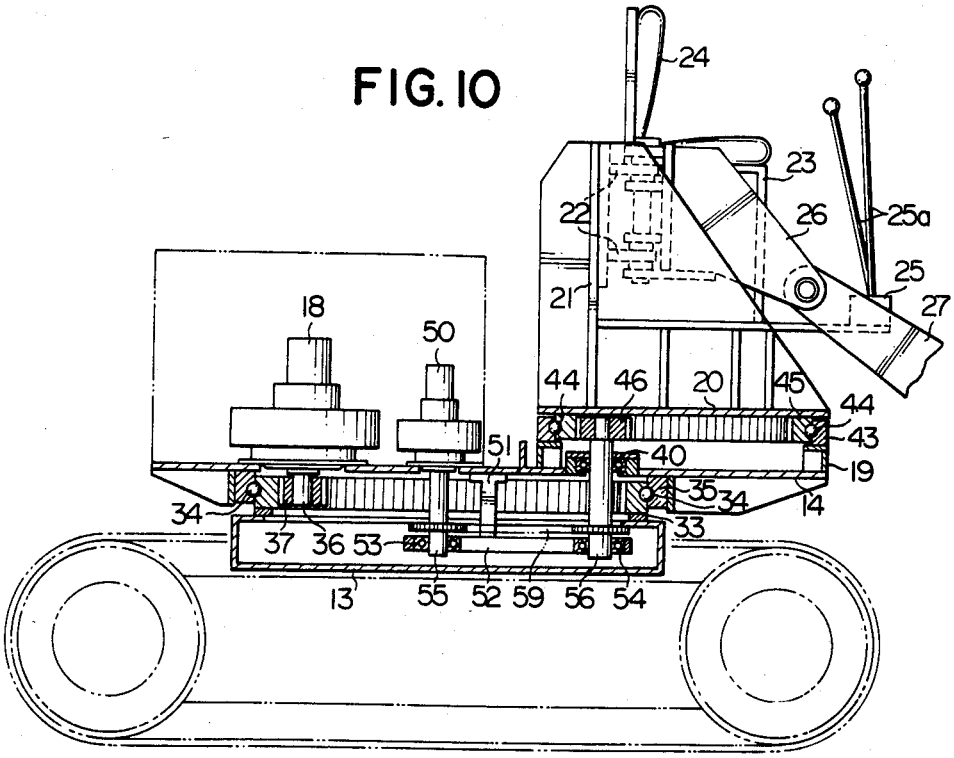
FIG. 10 is an enlarged cross-sectional view taken along line X—X of FIG. 9.
Figure 11:
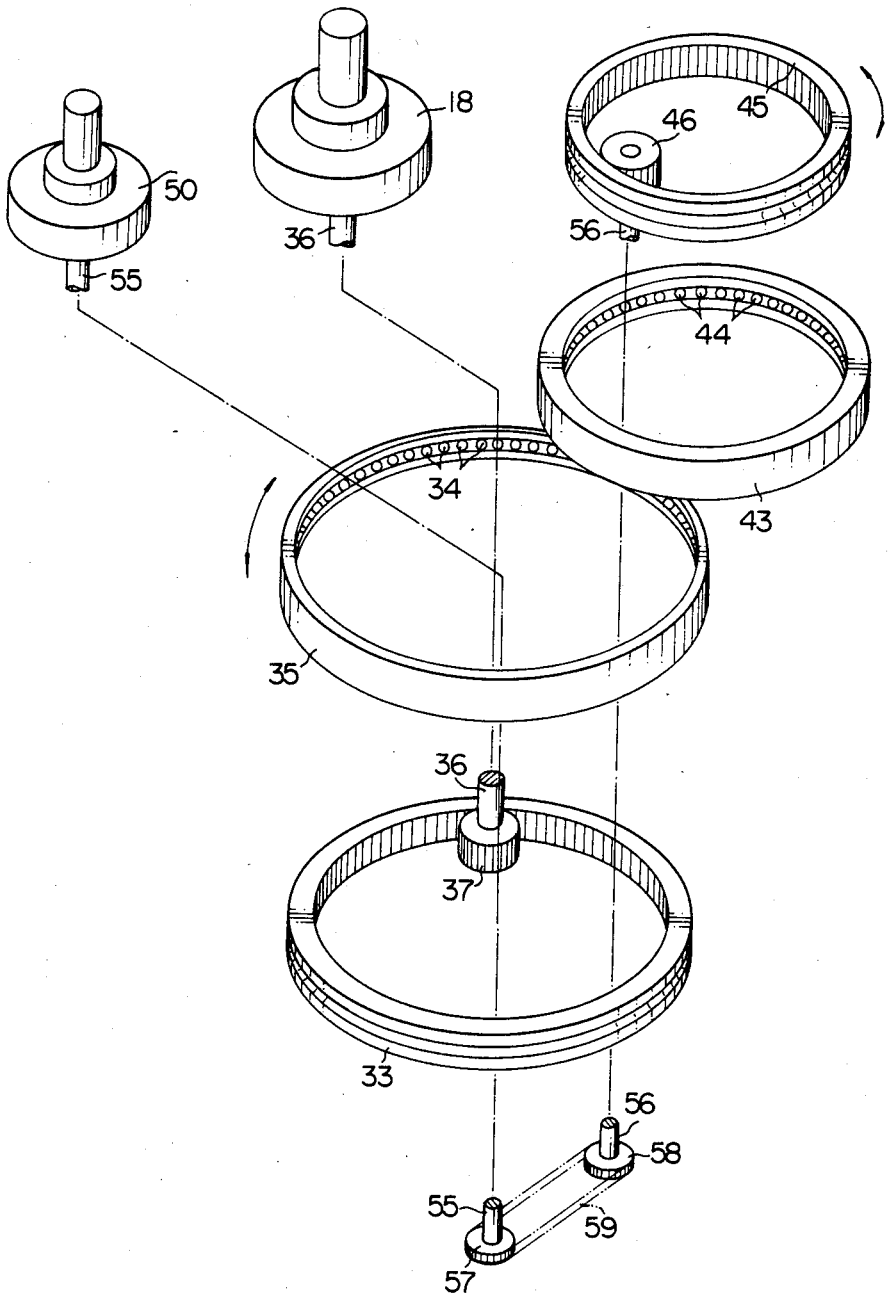
FIG. 11 is an exploded perspective view of a turning mechanism on the excavator illustrated in FIG. 9.
Figure 12:
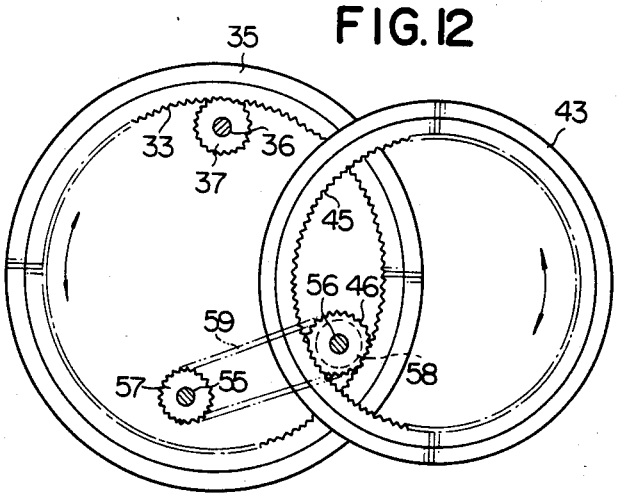
FIG. 12 is a plan view of the turning mechanism, as assembled, of FIG. 11.

FIGS. 9 through 14 illustrate an excavator according to another embodiment of the present invention. As best shown in FIG. 10, the excavator is similar in construction to the excavator shown in FIGS. 2 through 8, and hence the structural difference will mainly be described in detail. The turntable 14 also supports another hydraulic motor 50 mounted thereon and a T-shaped support 51 dependent therefrom and supporting on its lower end a bearing mount 52 on which a pair of bearings 53, 54 is mounted within the support base 13. The hydraulic motor 50 has a drive shaft 55 extending downwardly through the internal gear 33 into the support base 13 and having a lower end rotatably journalled in the bearing 53. An intermediate vertical shaft 56 is rotatably journalled in the bearing 40 on the turntable 14 and the bearing 54 on the bearing mount 52. As illustrated in FIG. 11, a pair of sprockets 57, 58 is secured to the shafts 55, 56, respectively, with an endless chain 59 trained around the sprockets 57, 58. The pinion 46 held in mesh with the internal gear 45 is affixed to the upper end of the intermediate shaft 56, as shown in FIGS. 10 and 11.

In operation, the bucket 29 (FIG. 2) with the digged material therein can be brought over the chassis 10 from the front to the rear position by actuating the hydraulic motors 18, 50 in synchronism to turn the turntable 14 and the carriage 20 in opposite directions. More specifically, the hydraulic motor 18 is actuated to turn the turntable 14 about the axis of the internal gear 33. At this time, the carriage 20 is angularly moved with the turntable 14 about the axis thereof. The hydraulic motor 50 is also operated to rotate the pinion 46 through the drive shaft 55, the sprocket 57, the chain 59, the sprocket 58, and the intermediate shaft 56. The internal gear 45 is then caused by the pinion 46 to rotate about its own axis. Therefore, the carriage 20 is rotated about the axis of the internal gear 45 while revolving around the axis of the turntable 14. The hydraulic motors 18, 50 are designed to rotate their shafts 36, 55 in opposite directions so that the excavating mechanism 47 (FIGS. 13 and 14) will turn in a direction opposite to the direction in which the turntable 14 rotates, toward the rear position over the engine 15, the fuel tank 16 and the hydraulic oil tank 17. By designing the system such that the carriage 20 will rotate through an angle twice larger than the angle of rotation of the turntable 14, the carriage 20 rotates through 360 degrees when the turntable rotates through 180 degrees to bring the excavating mechanism 47 from a front central position forward of the chassis 10 to a rear central position rearward of the chassis 10. While the excavating mechanism 47 is rotating above the carriage 20, the carriage 20 is positioned on one side of the chassis 10 with the excavating mechanism 47 as folded being located on the other side. There is no danger for the excavating mechanism 47 to project laterally when the turntable makes angular movement through 90 degrees. Therefore, the excavating mechanism 47 can be turned around within the width of the chassis 10.

Figure 13:
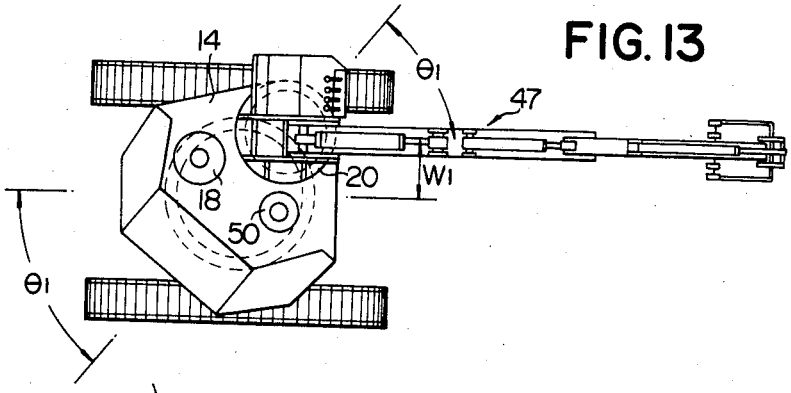
FIGS. 13 and 14 are plan views of the excavator of FIG. 9, which operates to dig side trenches.
Figure 14:
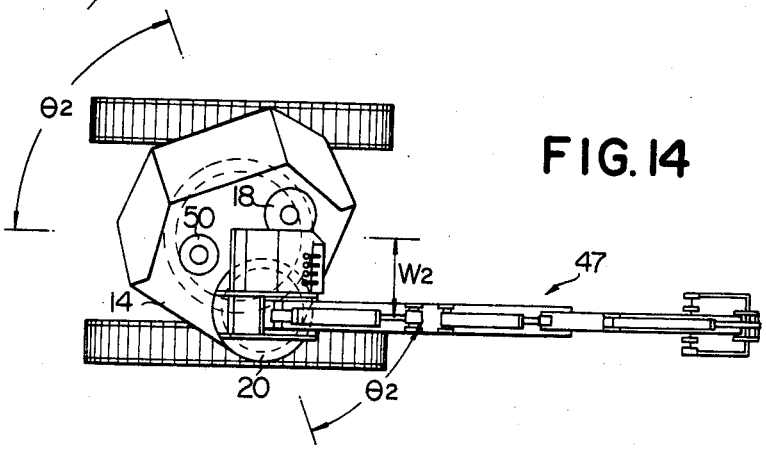

The hydraulic motors 18, 50 can be actuated independently of each other to allow the excavating mechanism 47 to dig side trenches as shown in FIGS. 13 and 14. More specifically, the hydraulic motor 18 is actuated to turn the turntable 14 slightly until the carriage 20 is angularly shifted counterclockwise to one side of the chassis 14 through an angle of $\theta_1$ as shown in FIG. 13. Then the hydraulic motor 50 is operated to rotate the carriage 20 clockwise with respect to the turntable 14 through the same angle $\theta_1$. The excavating mechanism 47 is now directed parallel to the longitudinal direction of the excavator with the bucket located in a lateral position spaced a distance W1 from the longitudinal axis of the excavator so as to make the bucket ready for trenching a side ditch. Thereafter, the hydraulic cylinders are actuated to enable the bucket to dig a side ditch or laterally enlarge an existing ditch. As shown in FIG. 14, the turntable 14 and the carriage 20 may be turned clockwise and counterclockwise through angles of $\theta_2$, respectively, to allow the bucket to trench another side ditch spaced a distance W2 from the longitudinal axis of the excavator. Although not shown, the turntable 14 and the carriage 20 may be adjusted in their angles of turn to enable the excavating mechanism 47 to project laterally beyond the width of the chassis 10 for digging an outside trench beyond one of the endless tracks.

Figure 15:
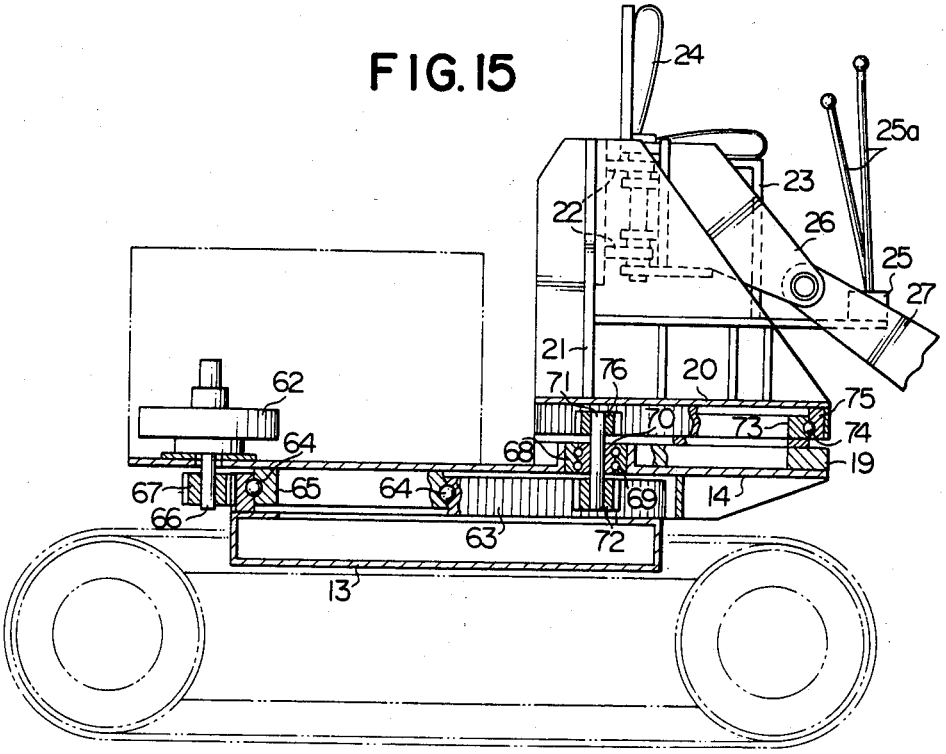
FIG. 15 is an enlarged cross-sectional view of an excavator according to still another enbodiment of the present invention.
Figure 17:
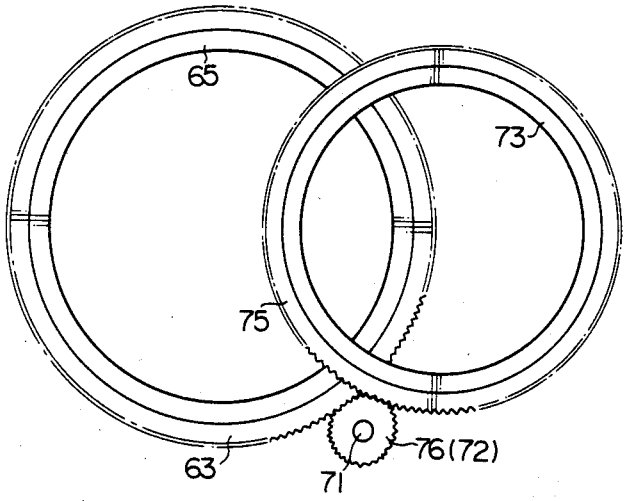
FIG. 17 is a plan view of the turning mechanism, as assembled, of FIG. 15.
Figure 16:
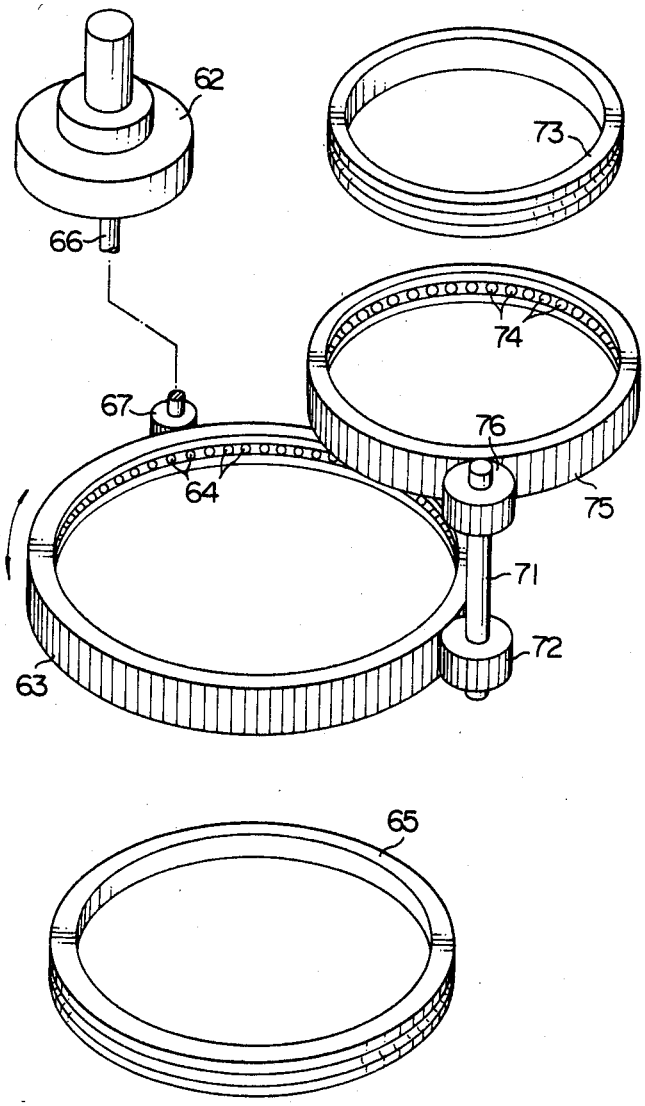
FIG. 16 is an exploded perspective view of a turning mechanism on the excavator illustrated in FIG. 15.

According to still another embodiment of the present invention as shown in FIGS. 15 through 17, the support base 13 supports thereon an annular external gear 63 fixed thereto in which a slider ring 65 secured to the turntable 14 is fitted with ball bearings 64 interposed between the external gear 63 and the slider ring 65. A hydraulic motor 62 is fixedly mounted on the turntable 14 and has a drive shaft 66 extending downwardly beyond the turntable 14 and has a pinion 67 held in driving mesh with the external gear 63. The turntable 14 has a shaft support ring 68 in which a bearing 70 with ball bearings 69 is fitted. An intermediate vertical shaft 71 is rotatably journalled in the bearing 70 and has on its lower end a pinion 72 held in mesh with the external gear 63. An annular holder 73 is mounted on the holder base 19 in coaxial relation thereof. The carriage 20 has an external gear 75 fixed to the underside thereof and rotatably fitted over the annular holder 73 in coaxial relation thereto with ball bearings 74 interposed therebetween. The carriage 20 is thus rotatable about the the axis of the annular holder 73. The intermediate shaft 71 has on its upper end a pinion 76 meshing with the external gear 75.

When the hydraulic motor 62 is actuated, the turntable 14 is rotated about the axis of the external gear 63. At the same time, the pinion 72 rotates in mesh with the external gear 63, and the pinion 76 also rotates to cause the external gear 75 and hence the carriage 20 to rotate about the axis of the annular holder 73 in a direction opposite to the direction in which the turntable 14 rotates. The carriage 20 is now caused to rotate about the axis of the annular holder 73 while revolving about the axis of the turntable 14. The bucket on the excavating mechanism as collapsed is then allowed to move from the front to the rear position over the devices on the turntable 14 without interfering with objects located laterally outside of the width of the chassis 10.

Figure 18:
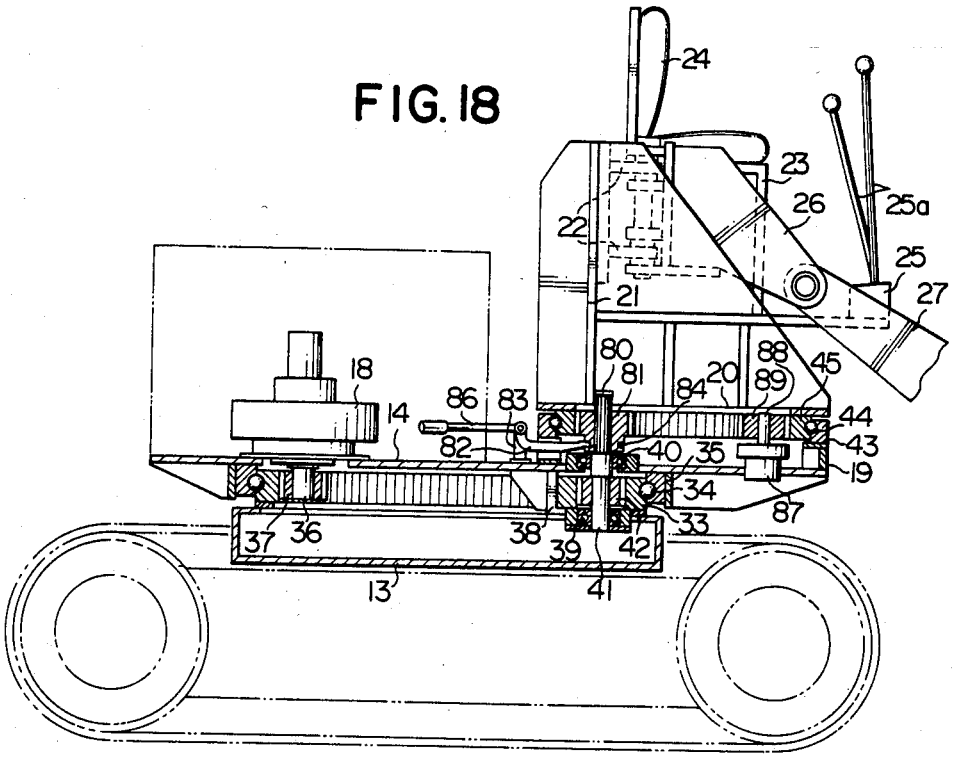
FIG. 18 is an enlarged cross-sectional view of an excavator according to a still further embodiment of the present invention.
Figure 19:
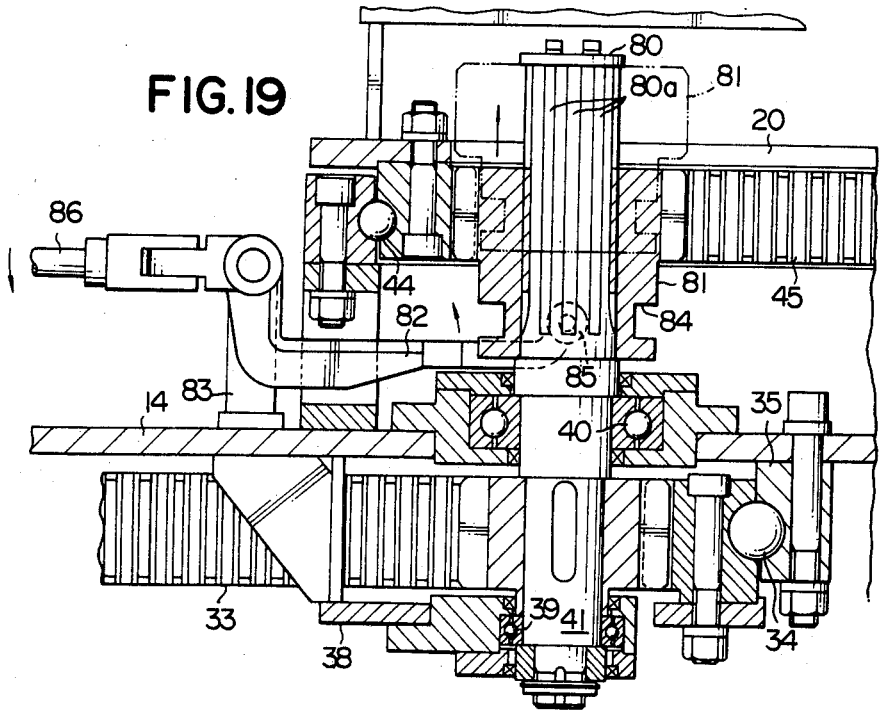
FIG. 19 is an enlarged fragmentary cross-sectional view of a cluth mechanism on the excavator shown in FIG. 18.
Figure 20:
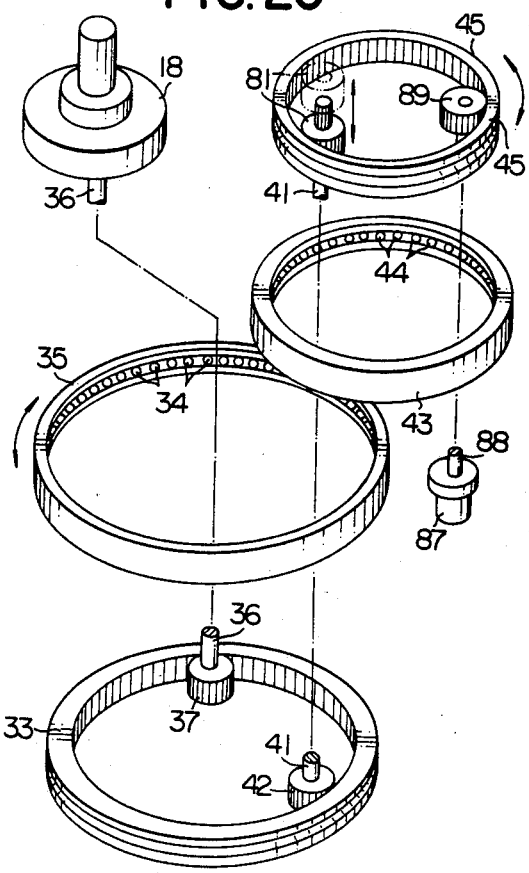
FIG. 20 is an exploded perspective view of a turning mechanism on the excavator shown in FIG. 18.
Figure 21:
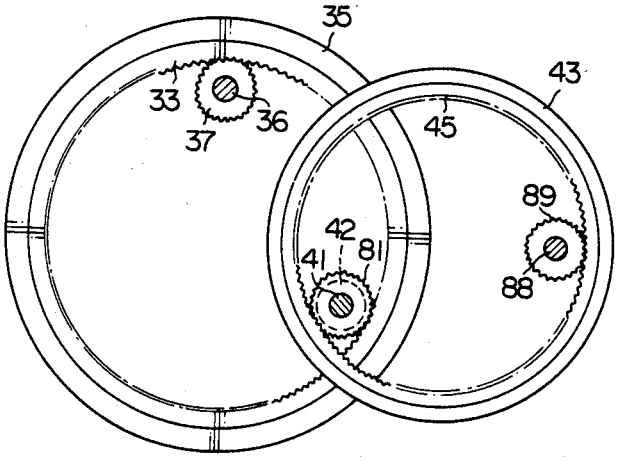
FIG. 21 is a plan view of the turning mechanism, as assembled, of FIG. 20.

FIGS. 18 through 21 are illustrative of an excavator according to a still further embodiment of the present invention. As shown in FIGS. 18 and 19, the hydraulic motor 18, the internal gears 33, 45, the pinion 42 and the bearings 39, 40 are basically of the same construction as that shown in FIG. 6. According to the embodiment of FIGS. 18 and 19, the intermediate shaft 41 journalled in the bearings 39, 40 has a vertical axial extension 80 extending through the internal gear 45 and having axial splines **80*a* (FIG. 19). A pinion 81 is axially slidably splined to the axial extension 80 and normally held in driving mesh with the internal gear 45. The pinion 81 is axially movable out of meshing engagement with the internal gear 45 when shifted in the direction of the arrow (FIG. 19). A lever 82 is pivotably mounted at one end on a support post 83 mounted on the turntable 14 and having on the other end a roller 85 riding in a groove 84 defined in the pinion 81. An actuator lever 86 is connected to the lever 82 and depressable toward the turntable 14 for angularly moving the lever 82 about the pivot on the support post 83 to shift the pinion 81 out of meshing engagement with the internal gear 45. The turntable 14 supports thereon another hydraulic motor 87 below the carriage 20. The hydraulic motor 87 has a drive shaft 88 extending vertically upwardly into the internal gear 45 and having a pinion 89 held in driving mesh with the internal gear 45**.

The excavator of the foregoing construction will operate as follows: For synchronous rotation of the turntable 14 and the carriage 20, the hydraulic motors 18, 87 are actuated and inactivated, respectively, with the pinion 81 kept in mesh with the internal gear 45. The turntable 14 is then rotated about the axis of the internal gear 33, and at the same time the pinions 42, 81 are rotated about their own axes. The internal gear 45 in mesh with the pinion 81 and hence the carriage 20 are rotated about the axis of the annular holder 43. Accordingly, the carriage 20 is rotated in one direction about its own axis while angularly moving with the turntable 14 in an opposite direction about the axis of the latter. The bucket of the excavating mechanism as folded is moved over the devices on the turntable 14 from the front position to the rear position without laterally projecting out of the space range substantially equal to the width of the excavator chassis.

When it is desired to rotate the turntable 14 and the carriage 20 independently of each other, the actuator lever 86 is depressed to turn the lever 82 counterclockwise to shift the pinion 81 axially upwardly out of meshing engagement with the internal gear 45. At this time, the internal gear 45 can rotate independently of the internal gear 33. Then, the hydraulic motor 87 is actuated to rotate the pinion 89 for thereby rotating the internal gear 45 in mesh therewith. The carriage 20 is therefore rotated solely by the hydraulic motor 87. The excavating mechanism can freely be rotated with the carriage 20 through 360 degrees to any desired position. Accordingly, the excavating mechanism can be positioned as desired with respect to the turntable 14; for example, the excavating mechanism may be shifted sideways to trench a side ditch, or may be stored over the turntable 14 with the latter remaining nonrotated. For rotating the turntable 14 and the carriage 20 synchronously again, the actuator lever 86 is lifted back to bring the pinion 81 downwardly into mesh with the internal gear 45. The hydraulic motor 18 is then actuated while the hydraulic motor 87 is rendered inoperative.

With the arrangements of the present invention, the bucket of the excavating mechanism can be brought back and forth between the front and rear positions with respect to the chassis over the devices mounted on the turntable. There is no danger for the bucket to project out laterally and hence interfer with activities around the excavator such as traffic on a lane of the road adjacent to the lane on which the excavator is used. Consequently, the digging operation of the excavator can be carried out in a minimum space range allowing as much traffic as possible adjacent to the excavator while in operation. According to some embodiments of the invention, the turntable and the carriage can be rotated synchronously in opposite directions through a simple gearing mechanism. With the other embodiments, the carriage can be rotated independently of the turntable so that the excavating mechanism can be laterally shifted for trenching desired side ditches or stored back above the turntable easily.

Although certain preferred embodiments have been shown and described, it should be understood that many changes and modifications may be made therein without departing from the scope of the appended claims.

What is claimed is:

1. An earth-working machine comprising:

a mobile chassis;

a first gear fixedly mounted on said mobile chassis;

a turntable rotatably supported on said first gear;

a carriage rotatably mounted on said turntable and having a second gear;

an earth-working mechanism mounted on said carriage;

a hydraulic motor mounted on said turntable and having a first pinion held in mesh with said first gear for rotating said turntable in a first direction; and a pair of coaxially co-rotatable second and third pinions mounted on said turntable and held in mesh with said first and second gears, respectively.

2. An earth-working machine comprising:

a mobile chassis;

a first gear fixedly mounted on said mobile chassis;

a turntable coaxially rotatably supported on said first gear;

a carriage rotatably mounted on said turntable in eccentric relation thereto and having a second gear;

an earth-working mechanism mounted on said carriage;

a hydraulic motor mounted on said turntable and having a first pinion held in driving mesh with said first gear for rotating said turntable in a first direction; and means on said turntable for rotating said carriage about an axis of said second gear through driving mesh with said second gear, said means comprises at least one bearing supported on said turntable, a shaft journalled in said bearing, and a pair of second and third pinions fixed to said shaft and meshing with said first and second gear, respectively, whereby said carriage can be rotated in a second direction opposite to said first direction in synchronism with rotation of said turntable when said hydraulic motor is actuated.

3. An earth-working machine according to claim 2, wherein said first and second gears comprise internal gears, respectively.

4. An earth-working machine according to claim 2, wherein said first and second gears comprise external gears, respectively.

5. An earth-working machine according to claim 1, further comprising decoupling means for decoupling the carriage from the turntable, and a second hydraulic motor mounted on said turntable and having a fourth pinion held in driving mesh with said second gear, whereby said carriage can be rotated by said second hydraulic motor independently of said turntable when said carriage is operatively decoupled from said turntable.

6. An earth-working machine according to claim 5, further comprising at least one bearing supported on said turntable, a shaft journalled in said bearing and including an axial extension having splines, said second pinion fixed to said shaft and meshing with said first gear, said third pinion splined to said axial extension and normally held in driving mesh with said second gear, and clutch means comprising said decoupling means and actuatable for shifting said third pinion on said axial extension axially out of meshing engagement with said second gear, whereby said carriage is operatively decoupled from said turntable and said carriage can be rotated by said second hydraulic motor independently of said turntable when said clutch means is actuated.

7. An earth-working machine according to claim 6, wherein said clutch means comprises a support post mounted on said turntable, a lever pivotably mounted on said support post and having a roller rotatably mounted on said lever and riding in a groove defined in said third pinion, and an actuator rod connected to said lever for angularly moving said lever to shift said third pinion out of meshing engagement with said second gear.

8. An earth-working machine comprising:

a mobile chassis;

a turntable mounted substantially centrally on said mobile chassis and rotatable with respect to said mobile chassis through any angular interval;

a carriage mounted on said turntable in eccentric relation thereto and rotatable with respect to said turntable through any angular interval;

an earth-working mechanism mounted on said carriage; and means on said mobile chassis, said turntable, and said carriage for rotating said turntable and said carriage synchronously with respect to each other, said means comprises a hydraulic motor mounted on said turntable and having a first pinion, a first annular internal gear fixedly mounted on said mobile chassis and in meshing engagement with said first pinion, a second pinion rotatably supported on said turntable and in meshing engagement with said first annular internal gear, a third pinion coaxially connected to said second pinion, and a second annular internal gear fixedly mounted on said carriage and in meshing engagement with said third pinion.

9. The earth-working machine according to claim 8, wherein said means further includes a first annular holder fixed to said turntable and slidably fitted over said first annular internal gear, a bearing assembly mounted on said turntable, a shaft rotatably mounted by said bearing assembly and supporting said second and third pinions, and a second annular holder fixed relative to said turntable and slidably fitted over said second annular internal gear.

10. An earth-working machine according to claim 1, further comprising a bearing assembly supported on said turntable, and a shaft rotatably journaled in said bearing assembly, said second and third pinions being mounted on said shaft in axially spaced relation to each other.

11. The earth-working machine according to claim 10, wherein said bearing assembly includes a pair of axially spaced bearings, said second pinion on said shaft is positioned axially between said axially spaced bearings, and said third pinion is positioned on an end of said shaft.

12. The earth-working machine according to claim 1, wherein said first and second gears comprise annular internal gears, respectively.

* * * * *